United States Patent [19]

Inoue

[11] Patent Number: 5,073,133

[45] Date of Patent: Dec. 17, 1991

[54] FUEL SUPPLYING SYSTEM FOR ENGINE OF OUTBOARD MOTOR

[75] Inventor: Seiji Inoue, Hamamatsu, Japan

[73] Assignee: Sanshin Kogyo Kabushiki Kaisha, Hamamatsu, Japan

[21] Appl. No.: 514,502

[22] Filed: Apr. 25, 1990

[30] Foreign Application Priority Data

Apr. 25, 1989 [JP] Japan ..... 1-105426

[51] Int. Cl.[5] ..... B63H 21/22

[52] U.S. Cl. ..... 440/1; 440/61

[58] Field of Search ..... 440/1, 2, 61; 123/329, 123/340; 180/277

[56] References Cited

U.S. PATENT DOCUMENTS 4,861,291 8/1989 Koike ..... 440/1
4,898,563 2/1990 Torigai et al. ..... 440/1
4,909,764 3/1990 Hirukawa et al. ..... 440/1
4,955,831 9/1990 Inoue et al. ..... 440/1

*Primary Examiner*—Jesus D. Sotelo
*Assistant Examiner*—Stephen P. Avila
*Attorney, Agent, or Firm*—Ernest A. Beutler

[57] ABSTRACT

An arrangement for insuring that an internal combustion engine of an outboard motor will operate efficiently under all trim adjusted conditions of the outboard motor. The trim angle is sensed and the fuel delivery system is adjusted to provide good running in response to the trim condition. Additionally, embodiments are disclosed wherein the fuel delivery system is also adjusted during initial starting so as to provide adjustment of the fuel delivery in response to both the starting condition and the trim condition. Both carbureted and fuel injected systems are disclosed.

17 Claims, 10 Drawing Sheets

FUEL SUPPLYING SYSTEM FOR ENGINE OF OUTBOARD MOTOR

BACKGROUND OF THE INVENTION

This invention relates to a fuel supply system for the engine of an outboard motor and more particularly to an improved fuel control that will adjust the fuel delivery in response to a variety of engine running conditions and also in response to the trim of the outboard motor so as to provide stable running regardless of the engine parameters and trim angle adjustment.

The normal practice with outboard motors is to mount them on the transom of the associated watercraft for adjustment of the trim angle of the outboard motor and particularly its propulsion unit so as to provide optimum running under all conditions. Although the adjustment of the trim angle of the propulsion unit improves the efficiency of the propulsion unit, changes in the trim angle can adversely effect the running of the engine. For example, if the engine employs a carburetor, the adjustment of the trim angle can change the head between the fuel bowl and the discharge nozzle and can adversely effect the running of the engine.

Moreover, it has been found that the trim adjustment of the outboard motor can effect running even if only small trim changes are made. This is particularly true when the engine is running at slow speeds or with the throttle in a relatively closed position. At low speeds or low throttle openings, the flow through the induction passage is quite slow and the fuel tends to flow along the walls of the induction passage rather than being primarily vaporized centrally therein. This is true regardless of whether the engine is carbureted or has a fuel injection system. Depending upon whether the induction system is at the front or the rear of the engine, the trim angle can cause the engine to run either rich or lean as the trim is adjusted. This, of course, can provide uneven and undesirable running characteristics.

It is, therefore, a principal object of this invention to provide an improved fuel control system for an outboard motor wherein the running is optimized under all running conditions and trim conditions.

It is a further object of this invention to provide an improved fuel control for an outboard motor engine that is responsive both to engine running conditions and trim angle under substantially all circumstances.

It is a further object of this invention to provide an improved fuel supply system for an outboard motor so as to promote good running under all running conditions and under all trim conditions.

In addition to the steady state running of an engine, even the starting of an engine can be effected by the trim angle at which the outboard motor is positioned. Obviously, if the trim angle and location of the induction system is such that fuel tends to flow by gravity away from the combustion chambers rather than toward them, then the starting can be effected.

It is, therefore, a still further object of this invention to provide an improved arrangement for controlling the starting delivery of fuel to an engine in response to its trim condition.

SUMMARY OF THE INVENTION

A first feature of this invention is adapted to be embodied in an engine control for an outboard motor that is adapted to be mounted for trim adjustment of the position of the outboard motor. The engine has a manual control for operator adjustment of the speed of the engine and a fuel system controlled by the manual control. In accordance with this feature of the invention, means are provided for sensing the trim condition of the engine and for adjusting the fuel system of the engine in response to the sensed trim condition to maintain normal running even when the trim condition is changed.

Another feature of the invention is also adapted to be embodied in an engine control for an outboard motor that is adapted to be mounted for trim adjustment of the position of the outboard motor. The engine has at least one of a fuel system and also has means for starting the engine. In accordance with this feature of the invention, there is provided means for sensing the trim condition of the engine and means for adjusting the fuel system of the engine in response to the sensed trim condition upon starting.

DETAILED DESCRIPTION OF THE PREFERRED EMBODIMENTS OF THE INVENTION

Figure 1:
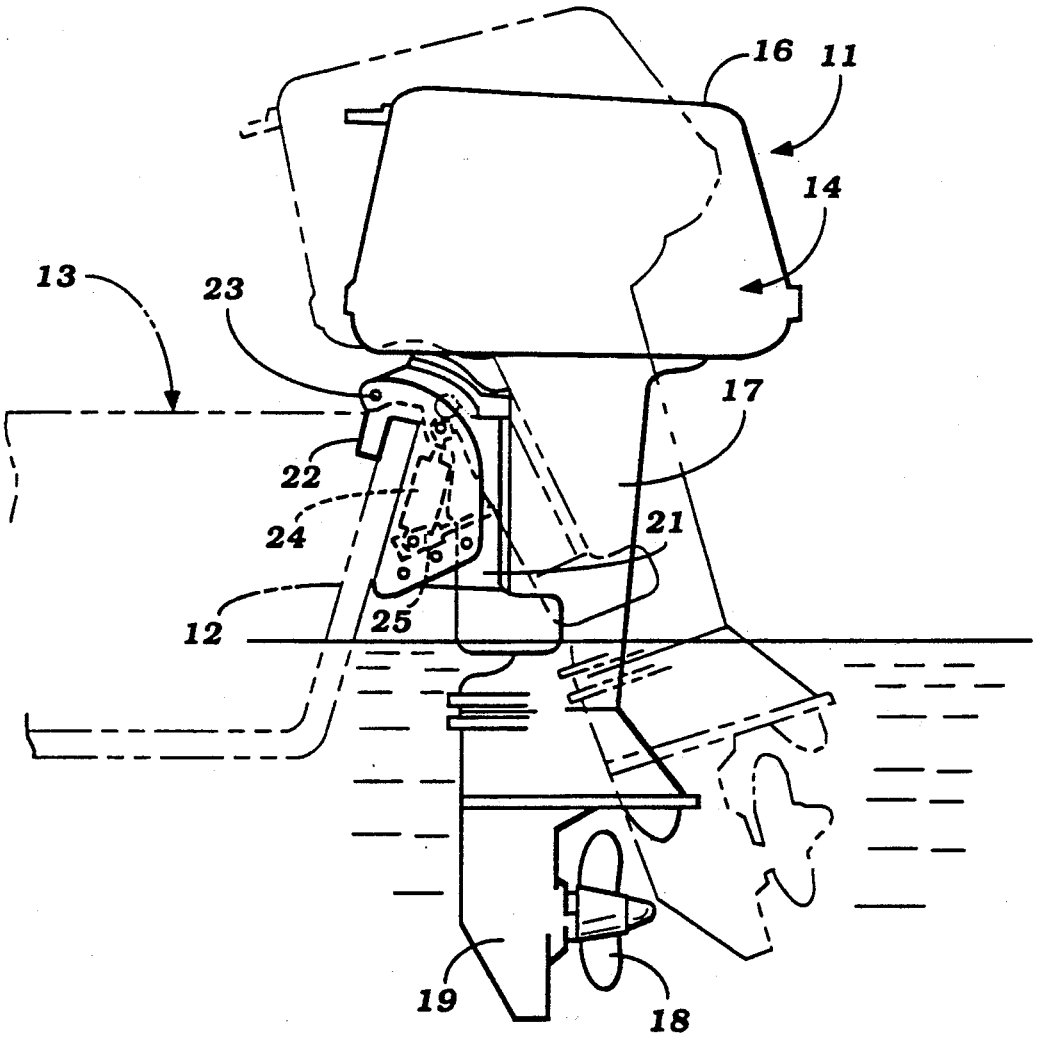
FIG. 1 is a side elevational view of an outboard motor as mounted on the transom of a watercraft and incorporating an embodiment of the invention.
Figure 2:
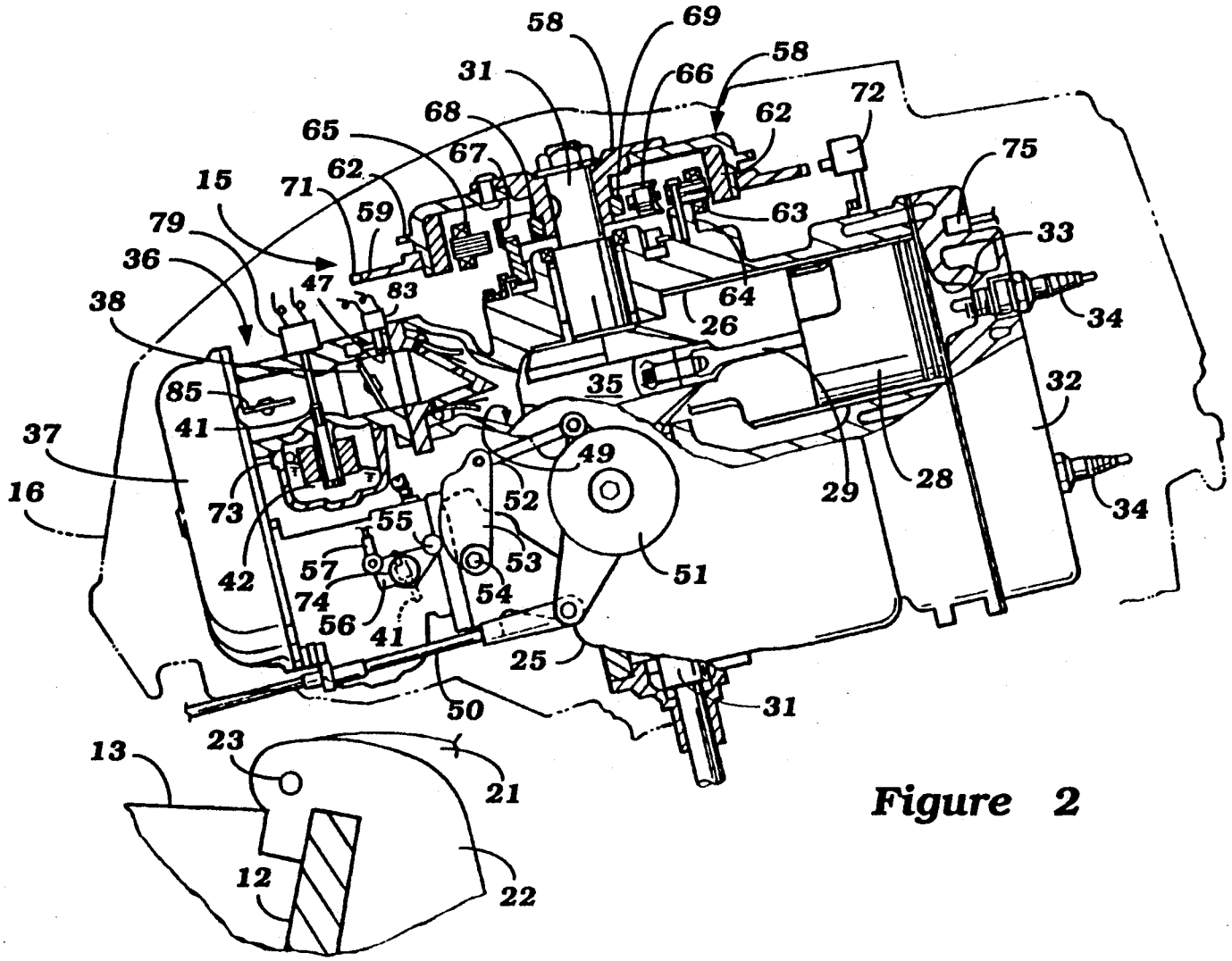
FIG. 2 is an enlarged side elevational view of the power head and mounting arrangement, with portions broken away and other portions shown in section.

Referring first to FIG. 1, an outboard motor, indicated generally by the reference numeral 11 and which has a control system constructed in accordance with an embodiment of the invention is mounted on a transom 12 of a watercraft 13. The outboard motor 11 is comprised of a power head, indicated generally by the reference numeral 14 and which comprises an internal combustion engine 15 as shown in FIG. 2 and a surrounding protective cowling, shown in phantom in this figure and identified by the reference numeral 16. As will be described in more detail, the engine 15 has an output shaft that drives a drive shaft journaled in an appropriate manner in a drive shaft housing 17 and which drives a propeller 18 of a lower unit 19 through an appropriate forward, neutral, reverse transmission (not shown).

A steering shaft (not shown) is affixed to the drive shaft housing 17 and is journaled for steering movement about a generally vertically extending steering axis within a swivel bracket 21. The swivel bracket 21 is, in turn, connected for pivotal movement to a clamping bracket 22 by means of a pivot pin assembly 23 for tilt and trim adjustment of the outboard motor 11.

In order to effect this tilt and trim adjustment, there is provided a tilt cylinder assembly 24 that is interposed between the clamping bracket 22 and the swivel bracket 21. In addition, there is provided a trim motor 25 that is carried by the clamping bracket 22 and which operates with the swivel bracket 21 so as to effect trim adjustment. The trim adjustment of the outboard motor 11 is through a relatively narrow range as shown by the solid and phantom line figures in FIG. 1 so as to adjust the angle of attack of the propeller 18 relative to the transom 12 so as to accommodate different running conditions and provide the optimum thrust. The tilt fluid motor 24 may be operated so as to raise the outboard motor 11 to a elevated out of the water condition. The hydraulic systems employed for this purpose are well known and since they form no part of the invention, description of them is not believed to be necessary to understand the operation of the invention.

Referring now in detail to FIG. 2, the internal combustion engine 15 is depicted as being of the two cylinder in line, crankcase compression, two cycle type. It is to be understood, of course, that the invention may be utilized in conjunction with other types of engines than two cycle type and also engines having different numbers of cylinders, different cylinder configurations and, in fact, rotary type engines.

In the illustrated embodiment, the engine 15 is comprised of a cylinder block 26 in which a pair of cylinder liners 27 (only one of which appears in this figure) extend in a horizontal direction, as is conventional outboard motor practice, to slidably support a respective piston 28. Each piston 28 is connected by means of a respective connecting rod 29 to a crankshaft 31 which rotates about a generally vertically extending axis and which drives the drive shaft, as aforenoted.

A cylinder head 32 is affixed to the cylinder block 26 in a known manner and defines a pair of recesses 33 each of which cooperates with a respective one of the cylinder bores and pistons 28 so as to define the combustion chamber. A spark plug 34 is mounted in the cylinder head 32 with its gap extending into the combustion chamber recess 33 for each cylinder.

The crankshaft 31 is rotatably journaled in a crankcase formed by the cylinder block 26 and which is formed with individual sealed chambers 35 for each piston 26. A fuel/air mixture is delivered to these chambers 35 by means of an induction and charge forming system, indicated generally by the reference numeral 36. This induction and charge forming system includes an air inlet device 37 that draws air from within the protective cowling 16 and delivers it to a pair of carburetors 38 shown in most detail in FIG. 3. Each carburetor 38 is comprised of a main housing defining a respective induction passage 39 in which a flow controlling throttle valve 41 is supported in a known manner. A fuel bowl 42 is maintained with a constant head of fuel by means of a float operated valve and supplies fuel to a main discharge nozzle 43 that is positioned in a venturi section of the induction passage of the carburetor 38 upstream of the throttle valve 41.

In addition, the carburetors 38 are provided with an idle and transition fuel discharge circuit 44 having an air metering jet 45 and a fuel metering jet 46. The idle and transition fuel discharge circuit 44 has an idle fuel discharge 47 from which fuel is controlled in a manner to be described and transition discharge ports 48 positioned upstream of the closed position of the throttle valve 41 for supplying a fuel/air charge during transitional operation.

The carburetors 38 deliver the fuel/air mixture to an intake manifold having individual runners 49 that discharge into the crankcase chambers 35. Reed type check valves of a known type preclude reverse flow through the manifold runners 49, as is well known in this art.

The position of the throttle valves 41 and, accordingly, the speed of the engine 15 is controlled by a throttle control system including a throttle control cable 50 that extends to a remotely positioned throttle actuator (not shown) and which rotates a throttle controlled drum 51 that is journaled on the cylinder block 25 in an appropriate manner. A control link 52 is pivotally connected at one end to the drum 51 and at the other end to a control cam 53 which is, in turn, journaled upon the intake manifold by means of a pivot pin 54. The throttle control cam 53 cooperates with a follower 55 that is affixed to a lever 56 which is, in turn, affixed to the shaft of one of the throttle valves 41 for positioning the throttle valve 41 upon rotation of the cam 53. The throttle valves 41 of the respective carburetors are connected to each other for simultaneous movement by means of a link 57 that is pivotally connected to the throttle control levers 56 of the respective carburetors.

The fuel/air charge which is delivered to the crankcase chambers 35 by the carburetors 38 is transferred upon descent of the pistons 28 into the combustion chambers 33 by transfer or scavenge passages in a known manner. At the appropriate time, as will become apparent, the spark plugs 34 are fired by an ignition system. The firing power for the spark plugs 34 is derived from a magneto generator, indicated generally by the reference numeral 58 and which includes a flywheel 59 that is affixed to the crankshaft 31 for rotation with it by a key and nut. The flywheel 59 carries a plurality of permanent magnets 62 that cooperate with a charging coil 63 that is affixed to a boss 64 of the cylinder block 25 in proximity thereto. In addition, the magneto generator 58 may include generating coils 65 for charging a battery (not shown) in a known manner.

There is provided further a trigger or pulser coil 66 that is mounted on a rotatable mounting ring 67 and which cooperates with magnet segments 68 and 69 so as to provide a signal when the crankshaft 31 is at a particular crank angle, which may be considered to be the fixed timing angle for the engine.

The engine 15 may also be provided with an electric starter including a starter ring gear 71 that is affixed to the flywheel 58 and which is driven by a suitable starter motor (not shown). A further sensor coil 72 may be associated with the teeth of the starter gear 71 for providing a signal that is indicative of the actual rotational angle of the crankshaft 31, for a reason to be described.

As has been noted, the outboard motor 11 is supported for trim adjusting movement and FIG. 2 of the drawings shows the engine 15 in a condition when the outboard motor 11 is adjusted to a trim up condition as shown in the phantom line view of FIG. 1. As may be seen, the fuel level 73 in the fuel bowl 42 will shift as the trim adjustment changes and this will change the head of fuel for both the main discharge nozzle 43 and also the idle and transition system 44. As a result, the running of the engine can be changed by changing of the trim angle of the outboard motor 11.

In addition to changing the head of the fuel between the discharge nozzle 43 and the fuel bowl 42, trim adjustment will also effect the angular inclination of the induction passages 39. Particularly at low running speeds and low throttle openings, this angular inclination will also effect the air/fuel ratio. Since the fuel generally flows along the walls of the induction passages 39 at low speeds, the fuel will have to flow uphill at a greater angle when the trim angle is increased. This can cause a leaning of the fuel/air mixture. In accordance with the invention, there is provided an arrangement wherein the fuel discharge from the carburetors 38 is adjusted in response to a variety of parameters so as to insure even running under all these conditions.

One of the parameters for controlling the fuel flow is the throttle valve position or air flow. There is, therefore, provided an air flow sensor, indicated generally by the reference numeral 74 which is a potentiometer type device that is connected to one of the throttle valve shafts so as to provide an output signal indicative of position of the throttle valves 41 and, accordingly, the air flow to the engine.

This sensing system includes further a trim position sensor, of a type later to be described in reference to FIG. 8. This sensor is also a potentiometer type of device and provides an output signal indicative of trim adjusted position. In addition to the controls as thus far described, the engine 15 is also provided with a knock sensor 75 which is mounted in the cylinder head 32 and which operates in a known manner so as to detect when one of the cylinders of the engine is knocking.

Figure 4:
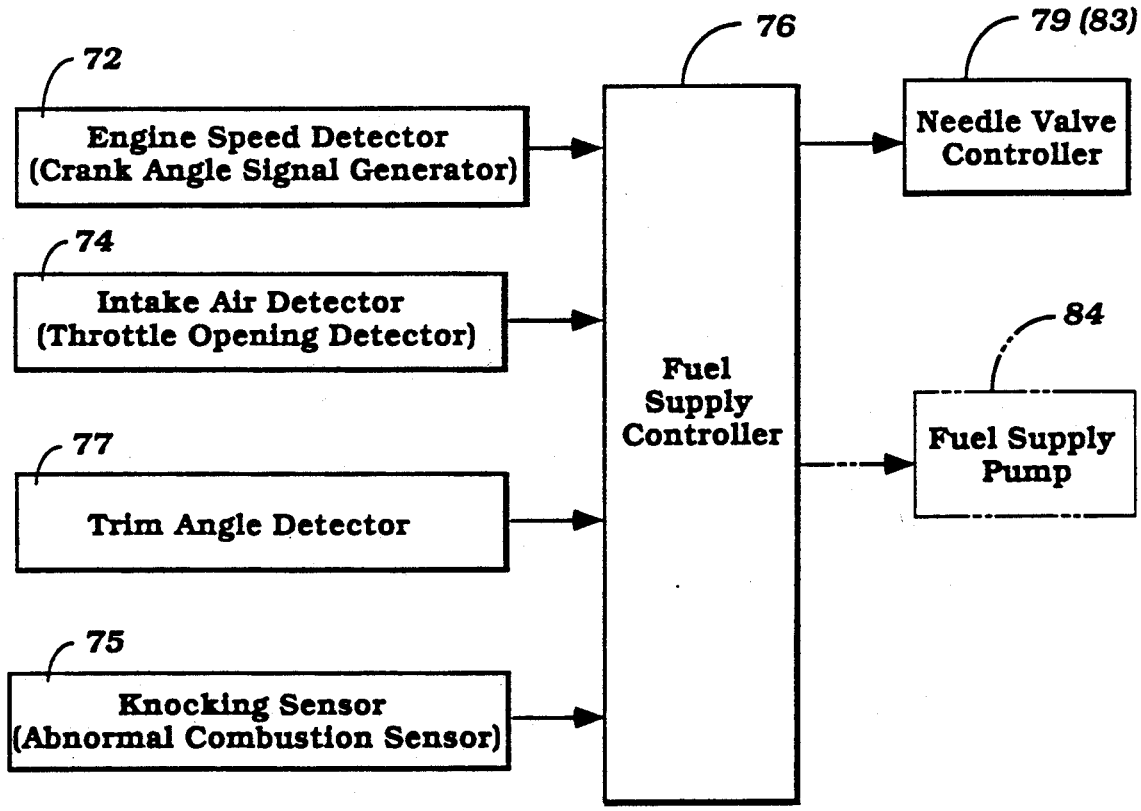
FIG. 4 is a schematic view showing the fuel control.

FIG. 4 shows how these various sensors are interrelated to the fuel control supplier, indicated generally by the reference numeral 76 and shown in block form. In addition, the trim angle detector, aforereferred to, is indicated in block form at 77 in this figure.

The fuel supply controller 76 may be of any known type of CPU with appropriate interfaces, RAMs and ROMs and receives specifically the engine speed signal generated by the crank angle detector 72, the air flow or throttle position, as indicated by the detector 74, the trim angle as indicated by the detector 77 and the existence or non existence of a knocking condition as shown by the indicator 75.

Referring again to FIGS. 2 and 3, the amount of fuel supplied to the engine is controlled by means of a main needle valve, indicated generally by the reference numeral 78 which is slidably supported within the body of the carburetors 38 and which cooperates with the main metering nozzle 43. The position of the main needle valve 78 is controlled by means of an electric solenoid or controller 79. It should be noted that the main metering system includes a main metering jet 81 of a fixed size that controls the flow of fuel from the fuel bowl 42 through the main nozzle 43. The needle valve 78 provides additional control.

In addition, an idle needle control 82 cooperates with the idle jet 48 and is controlled by a servo motor 83 for controlling the amount of idle fuel discharged. These needle valve controllers are shown schematically in FIG. 4. In addition, and if desired, the system may also be provided with a fuel pump control 84 that will control the amount of fuel delivered to the fuel bowl 42. However, in most instances and those involving a carburetor, such a fuel supply control will not be necessary. For normal cold starting enrichment, the engine is also provided with a choke valve 85 in each of the carburetors 38 which may be operated in any known manner.

Figure 3:
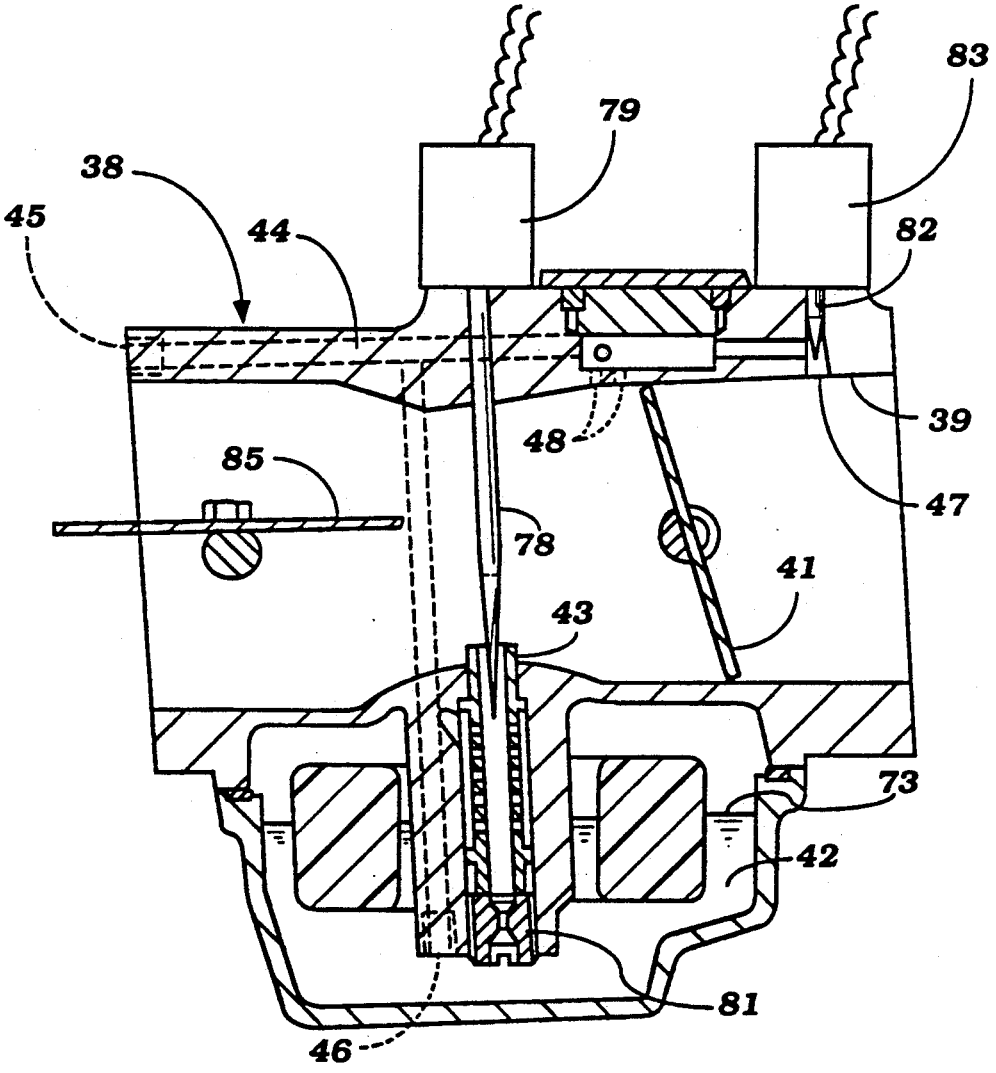
FIG. 3 is a still further enlarged cross-sectional view showing the carburetor.
Figure 5:
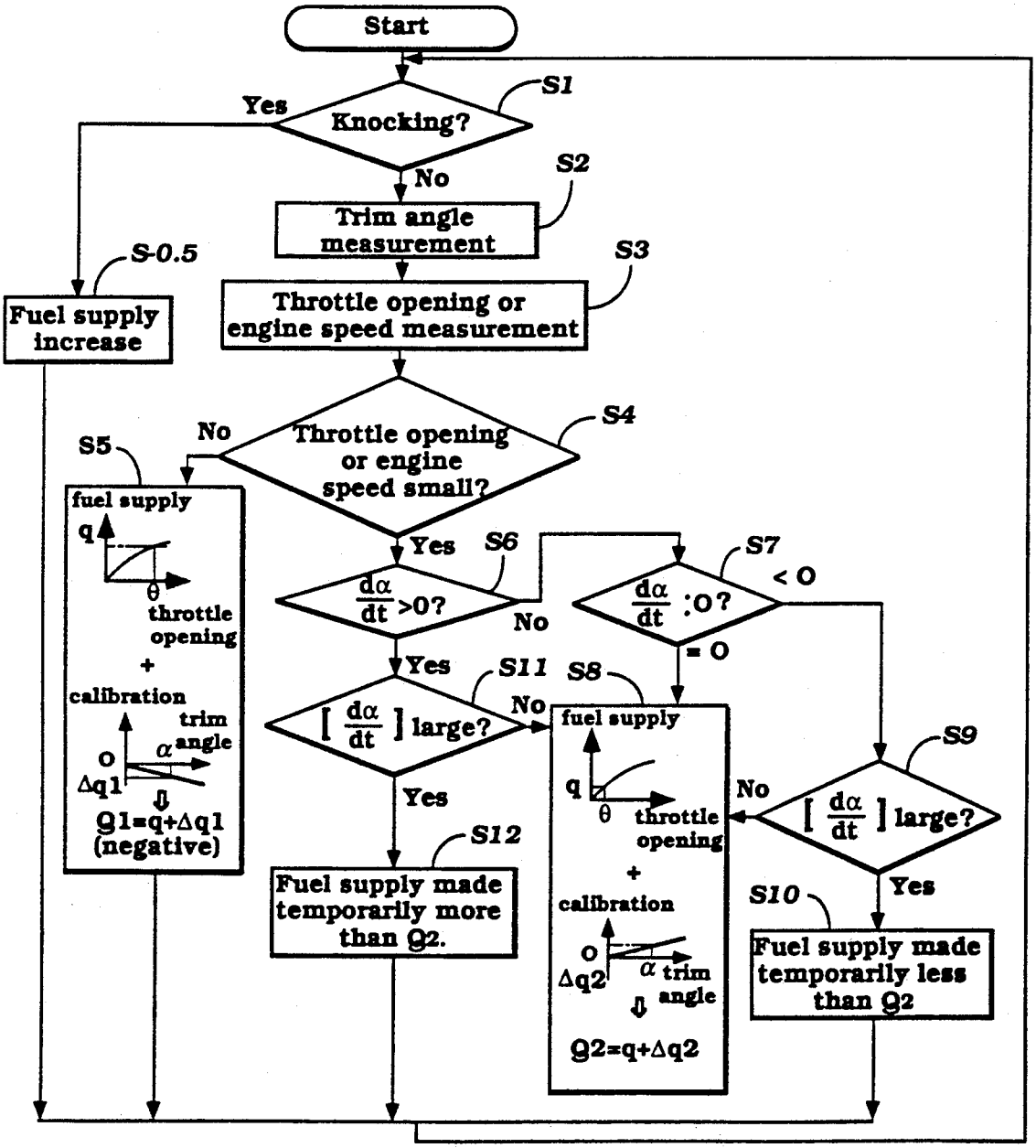
FIG. 5 is a block diagram showing the control routine of this embodiment of the invention.

Before describing the specific control strategy by reference to FIG. 5, some general comments are believed to be in order. As aforenoted, the amount of fuel delivered to the engine under various running conditions will depend upon the trim adjusted angle of the outboard motor 11 and specifically the engine 15 about the axis of the pivot pin 23. With the carburetor placement as shown in FIGS. 2 and 3, as the trim angle is increased, not only will the float level change the head of the fuel delivered to the main discharge nozzle 43 and the idle and transition system 44, but also the fuel flow uphill. The general construction is such that when trimming up to the maximum trim up position as shown in FIG. 2, both factors will reduce the engine fuel supply. The problem is particularly aggravated at low throttle openings since the fuel flows, as aforenoted, primarily along the walls of the induction passages 39 and hence further leaning of the fuel/air mixture will result because of this trimming up. Therefore, the system is generally designed so as to provide certain enriching, as will described, depending upon the trim angle and throttle angle.

Referring now to FIG. 5, once the program starts, it first moves to the step S-1 to determine if the knock sensor 75 has outputted a signal indicative of knocking. If so, the program moves to the step S 0.5 and supplies additional fuel by actuating the solenoid 79 to open the valve 78 then returns.

Assuming that a knock condition has not been determined at the step S-1, the program moves to the step S-2 to measure the trim angle by means of the trim angle sensor 77 and then measures either engine speed or throttle valve opening at the step S3. At the step S-4 it is determined if the throttle opening is large or small. A small throttle opening is a throttle opening position wherein the effect of the trim angle changes could have a significant effect on the air/fuel ratio of the engine due to the aforenoted factors of inclination of the induction passage.

If it is determined that the throttle opening is not small at the step S-4, the program moves to the step S-5 wherein the appropriate fuel supply is set. The fuel supply q is determined by the following relationship:

$$Q_1 = q + \Delta q_1$$

In the foregoing equation, q is the basic fuel supply determined by a fuel supply curve in relation to throttle opening while $\Delta q_1$ is a calibration factor determined from a calibration curve that is dependent upon trim angle and one which is negative.

If, however, it is determined at the step S-4 that the throttle opening or engine speed is low, then a determination is made at the step S-6 to determine if the trim up condition is still being encountered. That is, a determination is made as to whether $da \div dt$ is greater than 0.

If it is determined at the step S-6 that the outboard motor is still being trimmed up, the program moves to the step S-11 to determine if the rate of change of the trim up is being accelerated as indicated by integrating the rate of change of the trim angle curve with respect to time. If rapid trim up is being encountered, the program moves to the step S-12 wherein a temporary fuel enrichment is accomplished.

If, however, at the step S-6 it is determined that the rate of trim up is relatively small, the program moves to the step S-8 wherein the fuel flow is set in a manner as will be described. If at the step S-6 it is determined that the outboard motor 11 is not being trimmed up, that is da÷dt is not greater than 0, the program then moves to the step S-7 to determine if trim up has stopped. That is, it is determined if da÷dt is equal to 0. If it is equal to 0, then the program moves to the step S-8 to set the permanent fuel flow or supply in accordance with the equation $Q_2=q+\Delta q_2$ in accordance with this step. The $\Delta q_2$ in this step is, however, a fuel enrichment as opposed to a spark retard because at small throttle openings the increased uphill fuel flow can retard the amount of fuel delivery and adversely effect the engine running.

If, however, at that step 28 it is determined that the change in trim angle is less than 0, this is an indication that there is a trim down condition and the program moves to the step S-9 to determine if the rate of change of the trim is large or small. If it is not large, the program moves to the step S-8 to set the fuel flow in the aforedescribed manner. If, however, it is determined at the step S-9 that there is rapid trim down occurring, then the program moves to the step S-10 so as to provide a temporary reduction in fuel flow to stabilize the running and frequent overrichness due to a reduction in the incline up which fuel must flow until the trim operation is either stopped or slowed.

Figure 6:
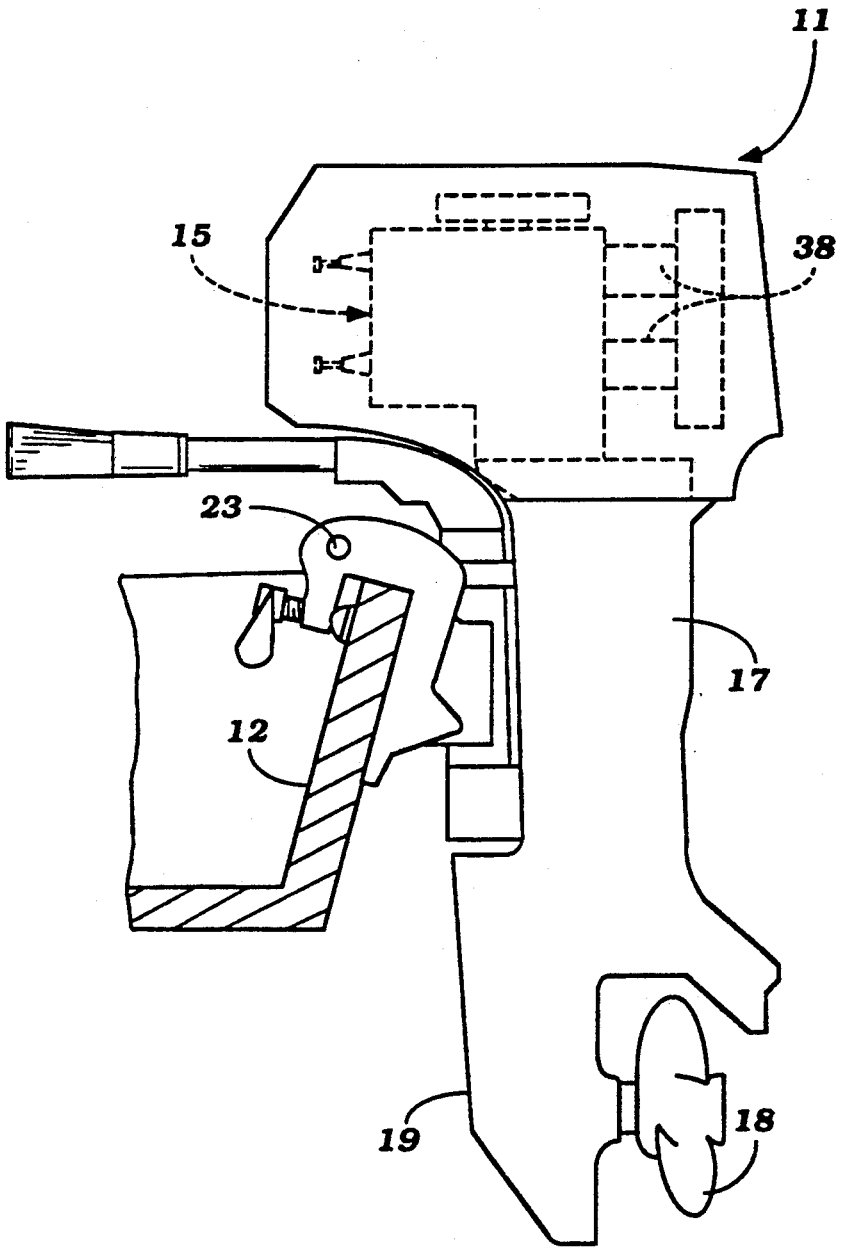
FIG. 6 is a side elevational view, in part similar to FIG. 1, showing another embodiment of this invention.
Figure 7:
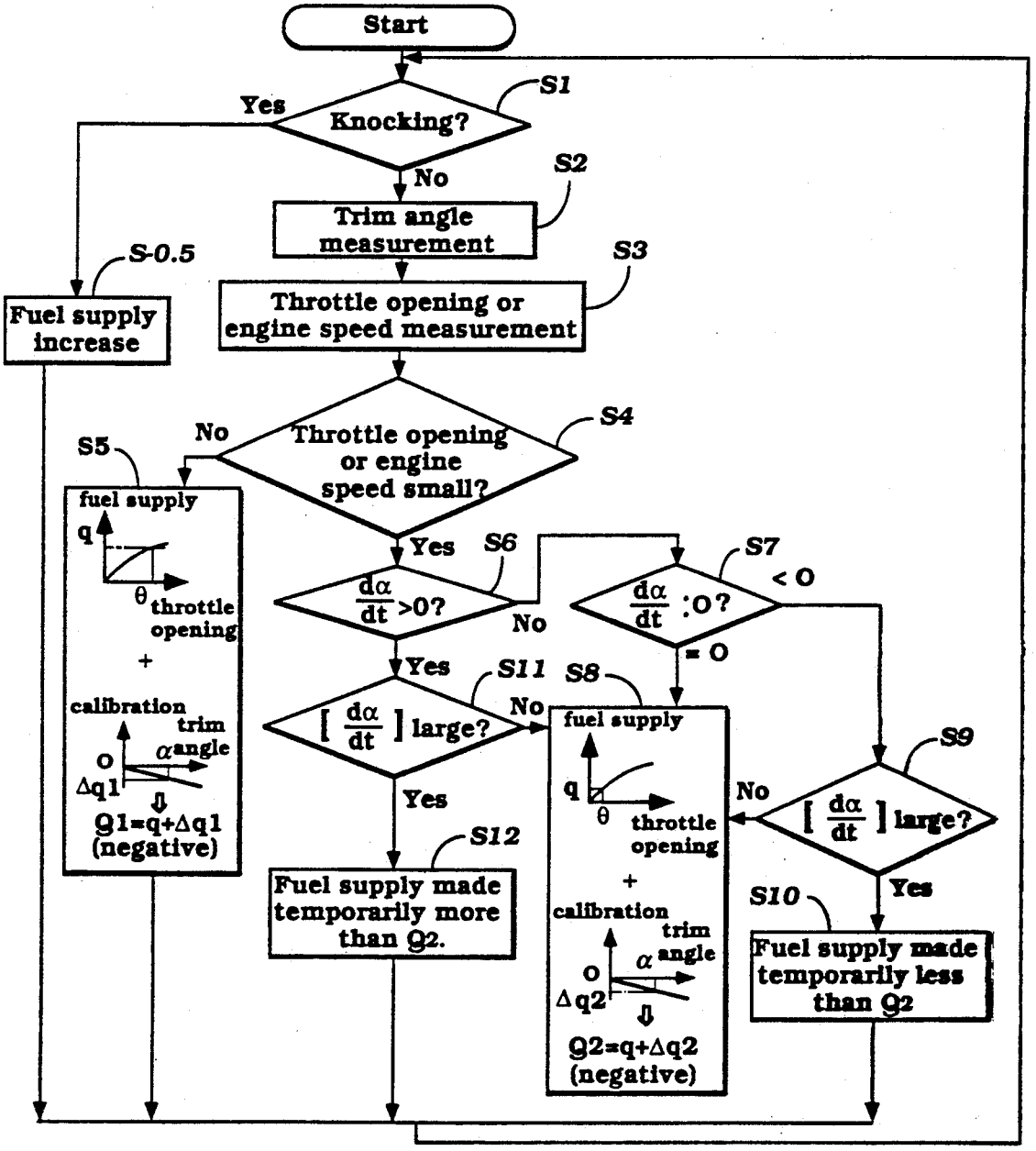
FIG. 7 is a block diagram, in part similar to FIG. 5, showing the control routine of this embodiment.

The aforedescribed example of FIG. 5 was for an engine having an orientation as shown in FIGS. 1 through 3 wherein a trim up would increase the angle through which the fuel must flow to the engine and thus tends to cause a leaning of the induction system at low throttle openings. However, there are other engine orientations and such an orientation is shown in FIG. 6. Because of the similarity of this embodiment to the previously described embodiment, the components have been identified by the same reference numerals and will not be described again. However, it should be noted that in this embodiment, the carburetors 38 are positioned at the opposite end of the engine from the embodiment of FIGS. 1 through 3. Therefore, as the engine is trimmed up, the fuel will tend to flow in a downhill fashion as the trim angle increases rather than an uphill fashion. To accommodate this, the fuel flow adjustments at low throttle openings must be reversed from the embodiment of FIG. 5 and FIG. 7 shows such a reversed construction. Because of the other similarities of this embodiment to the previously described embodiment, it is believed unnecessary to describe the routine thereof. However, it should be noted that the correction factor in the step S-8 is a reduction or negative calibration rather than an increase on positive calibration. The difference in fuel correction due to trim angle in connection with this embodiment from the previous embodiment only applies under the condition of low throttle openings. The high speed conditions are the same as the previously described embodiment because the float level changes will be in the same direction regardless of whether the carburetors are to the front or the rear of the engine. Of course, in situations where the float level changes in the opposite sense, obviously opposite calibrations must be made. It is believed within the scope of those skilled in the art to make such changes in the routine with the aforedescribed construction.

Figure 8:
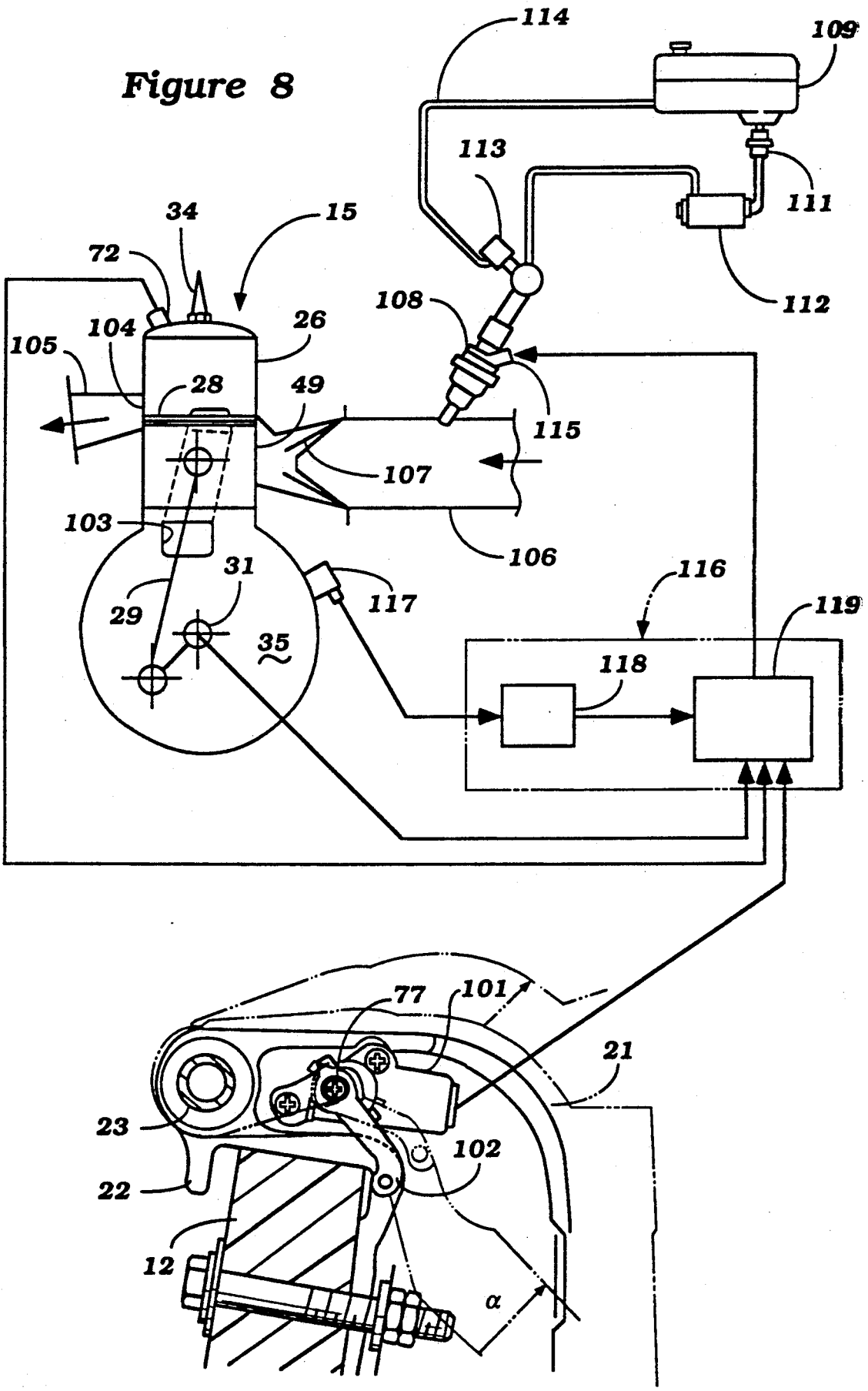
FIG. 8 is a partially schematic side elevational view of a trim sensor which can be utilized with any of the embodiments as thus far described and applied to an engine control for an outboard motor having a fuel injection system.

In all other regards, this embodiment is the same as those previously described Also, it should be noted that, although the invention has been described in conjunction with carbureted engines, certain facets of the invention also have practicality with fuel injected engines and such an embodiment is shown in FIG. 8.

In this embodiment, certain components of the basic engine construction and of the outboard motor itself are the same as the embodiments as thus far described. Where that is the case, those components have been identified by the same reference numerals and will not be described again, except insofar as is necessary to understand the construction and operation of this embodiment.

In this embodiment, the trim angle sensor 77 is depicted. It should be noted that the sensor 77 includes a body portion 101 that is carried by the swivel bracket 21 and which has an internal resistance winding that is contacted by a wiper arm connected to an external arm 102 that is pivotally connected on the housing 101 by the shaft of the wiper arm and which engages the transom 12. As the trim angle changes through the angle a, the wiper arm of the rheostat will change the output signal and provide a signal indicative of trim angle as should be readily apparent.

Also, in this embodiment, a scavenge port 103 is depicted which transfers the charge from the crankcase chamber 35 to the combustion chamber. Also depicted is an exhaust port 104 and exhaust pipe 105. These are basic components of the engine which also are present in the previously described embodiment, but which were not illustrated therein since their construction is well known.

An intake pipe 106 communicates with the manifold passageway 49 through a reed valve 107 as in the previously described embodiment. However, an electronically controlled high pressure fuel injector 108 discharges fuel into the intake pipe 106.

Fuel is supplied to the injector nozzle 108 from a fuel tank 109 and fuel filter 111 under pressure by a pump 112. A pressure regulating valve 113 is carried by the injection nozzle 108 so as to provide a uniform or regulated pressure to the injector nozzle with the excess fuel being returned to the fuel tank 109 through a return conduit 104.

The injector nozzle 108, as has been previously noted, is of the electronically operated type and includes a controlling solenoid 115 that is operated by a controller, indicated generally by the reference numeral 116. A crankcase pressure sensor 117 outputs a pressure signal to an analog to digital converter 118 of the controller 116. This converted signal is then transmitted to a controller 119 so as to provide a crankcase pressure signal to the control unit 119. The basic control strategy of the control unit 119 may be of any known type but is modified so as to employ a system for calibrating the fuel control either in accordance with the embodiment shown in FIG. 5 or the embodiment shown in FIG. 7, depending upon whether the induction passages are disposed as shown in the embodiment of FIGS. 1 through 3 or as in the embodiment of FIG. 6. Since float level changes are not a problem, only calibration need be made for the inclination of the angle of the induction passage. That is, in control strategies as shown in FIGS. 5 and 7 the value of $q_1$ in step S-5 will be zero and the value of $\Delta q_2$ of step S-8 will be reduced.

Figure 9:
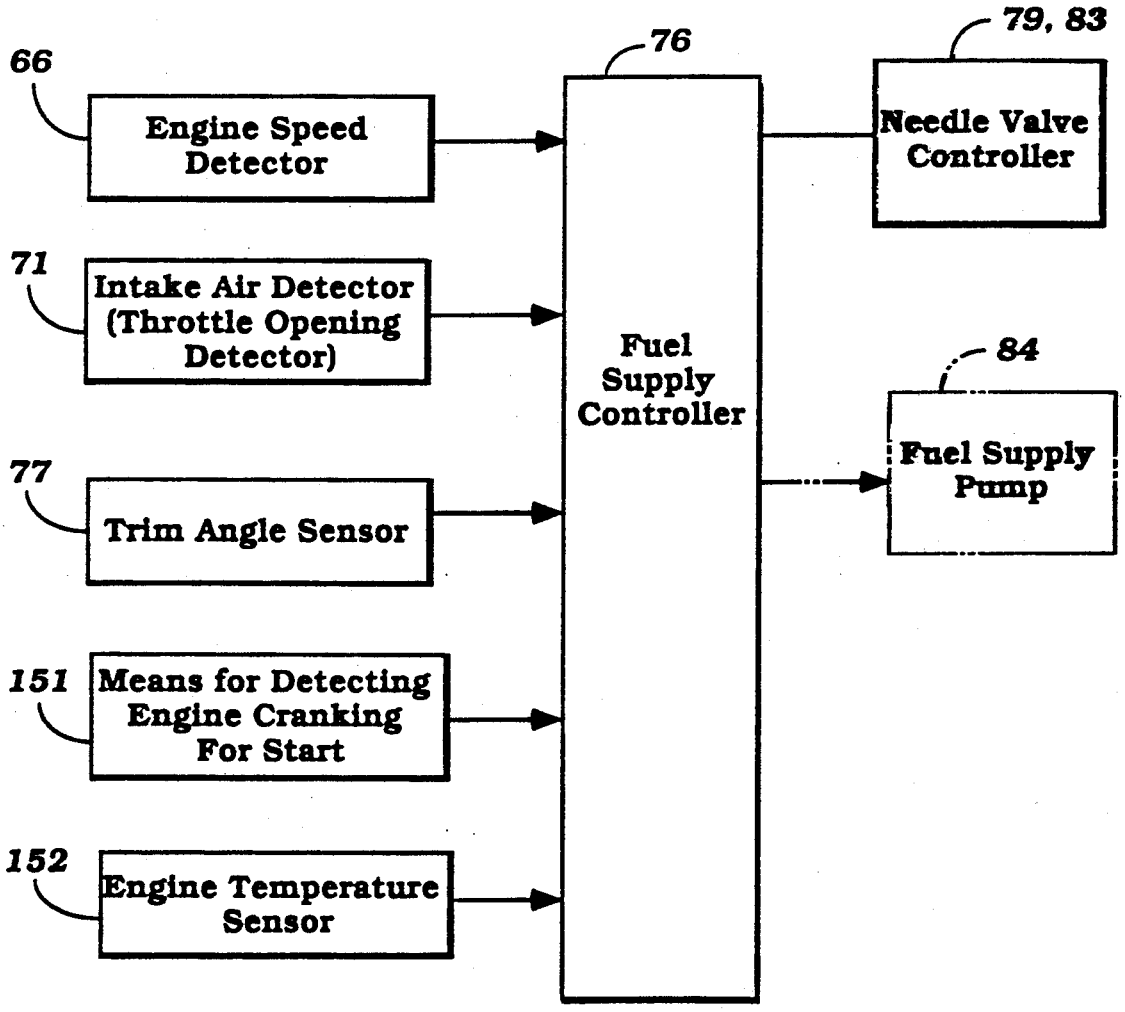
FIG. 9 is a block diagram showing the components an interrelationship for a system wherein the fuel control is varied in response to starting in addition to trim condition.
Figure 10:
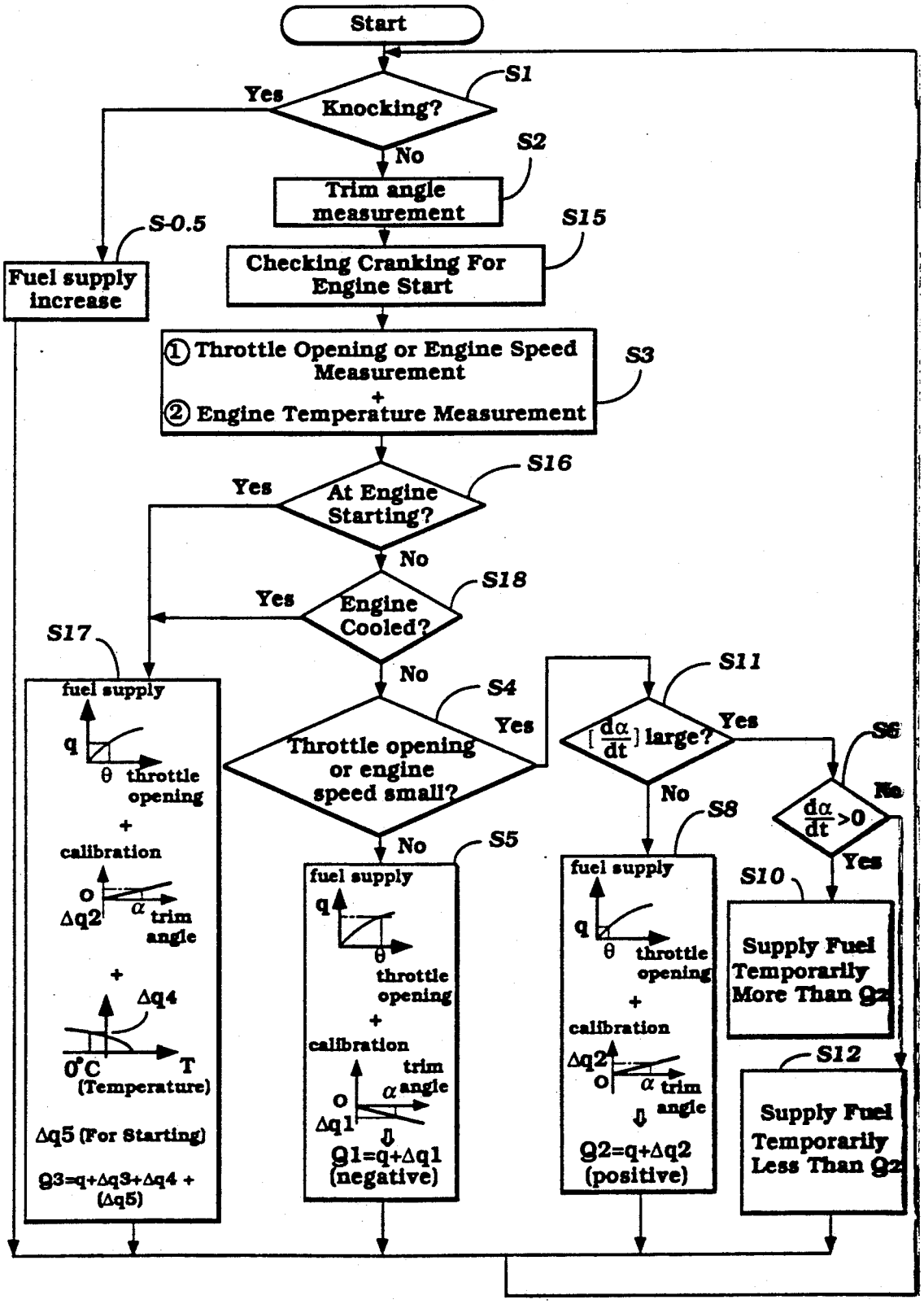
FIG. 10 is a block diagram of the control routine in accordance with the embodiment of FIG. 9 showing the control routine during engine starting and running.

In the embodiments as thus far described, the fuel supply has been adjusted to compensate for fuel/air variations which may be caused as a result of changes in trim angle. In addition to such running condition changes, it may also be desirable to adjust the fuel supply in response to trim angle during starting in order to assist in starting. FIGS. 9 and 10 show such an embodiment. In FIG. 12, the various components of the system are depicted in block form and include several components of the previously described embodiments. In those cases the embodiments have been identified by the same reference numerals. These controls may include an engine speed detector 66 such as the pulser coil of the ignition circuit, and air intake volume sensor 71, which may comprise the throttle angle detector and the trim angle sensor 77. In addition, there is also provided a detector 151 for detecting the occurrence of the start of engine cranking and an engine temperature detector 152 that determines whether the engine temperature is cool or has reached its normal operating temperature. These signals are all outputted to the controller 76 which operates the fuel supply 79, 83 and/or a fuel supply pump 84 in a manner as generally described previously.

A routine of operation for this embodiment is illustrated in FIG. 10 and follows generally the routine of FIGS. 5 or 7, depending upon the orientation of the induction system for the engine. Where steps are the same or substantially the same as the routines in FIGS. 5 and 7, they have been identified by the same reference numerals. Therefore, it will be noted that at the step S-1, the existence of a knocking condition is determined. If a knocking condition is determined, the routine moves to the step S-0.5 to increase the fuel supply. If, however, knocking is not present, then the program moves to the step S-2 to again measure trim angle. The routine then moves to a step S-15 wherein it is determined by reading the engine starting detector 151 to see if the engine is being initially cranked. Also, the throttle opening or speed is measured at the step S-3 as previously described and also at this same step the engine temperature is measured by detecting the output from the temperature sensor 152.

The routine then moves to the step S-16 to determine if the engine is being started initially. If so, the program moves to the step S-17 to set the spark advance in response to the various measured conditions in accordance with the following equation:

$$Q_3 = q + \Delta q_3 + \Delta q_4 + (\Delta q_5)$$

The $\Delta q_3$ is the amount of fuel required beyond the fixed fuel flow curve for the throttle opening in question is as derived by a calibration curve q experimentally obtained. In addition, the $\Delta q_4$ factor is determined by another calibration curve related to temperature. $\Delta q_5$ is a still further enrichment or priming for the condition during engine starting.

If it is determined at the step S-16 that the engine is not being initially cranked, then the program moves to the step S-18 to determine if the engine is below its normal operating temperature. If it is, then the program returns to the step S-17 to provide the aforedescribed enrichment. However, the calibration factor $\Delta q_5$ for initial cranking is not added to the fuel supply.

If, at the step S-18 it is determined that the engine is at its normal operating temperature, then the routine moves to the step S-4 for setting the fuel flow in the manner generally previously discussed. That is, if the throttle opening is not small, the program moves to the step S-5 to set the fuel flow in accordance with the factors previously described.

If, however, it is determined that the throttle opening is small, then the routine moves to a step S-11 where a determination is made as to whether or not the trim angle change with respect to time is large. If it is not, the program moves to the step S-8 wherein the fuel supply is set in accordance with the following equation:

$$Q_2 = q + \Delta q_2.$$

In this embodiment, the $\Delta q_2$ is a fuel calibration determined from a calibration curve.

If, however, at the step S-11 it is determined that the trim angle is being changed rapidly, then the program moves to the step S-6 to determine if the outboard motor 11 is not being trimmed up. If the outboard motor 11 is being trimmed up, the program moves to the step S-10 so as to temporarily increase the amount of fuel supplied greater than the value $Q_2$. If, on the other hand it is determined that there is no trim up, then the program moves to the step S-12 and supplies an amount of fuel that is temporarily less than the value $Q_{-2}$.

It should be noted that the calibrations in this embodiment are similar to those of the embodiment of FIG. 5 with an engine having a configuration as shown in FIGS. 1 through 3. Application to the other configurations of engines should be well within the scope of those skilled in the art from the foregoing description.

It should be readily apparent that the number of embodiments described are extremely effective in providing good running of an engine associated with an outboard motor regardless of the trim angle of the outboard motor and during all running conditions and also during starting. Although several embodiments of the invention have been illustrated and described, various changes and modifications may be made without departing from the spirit and scope of the invention, as defined by the appended claims.

I claim:

1. In an engine control for an outboard motor including an engine and adapted to be mounted for trim adjustment of the position of the outboard motor, said engine having a manual control for operator adjustment of the speed of said engine, and a fuel system controlled by said manual control, the improvement comprising means for sensing the trim condition of the outboard motor and means for adjusting the fuel system of the engine in response to the sensed trim condition to maintain normal running even when the trim condition is changed.

2. In an engine control as set forth in claim 1 wherein the engine is provided with a fuel supply system in which the air fuel ratio may vary in response to trim angle.

3. In an engine control as set forth in claim 2 wherein the fuel supply system comprises a float operated device.

4. In an engine control as set forth in claim 3 wherein the float operated device comprises a carburetor.

5. In an engine control as set forth in claim 4 wherein the means for adjusting the fuel system adjust the fuel flow.

6. In an engine control as set forth in claim 5 wherein the fuel flow is a main fuel flow and the main fuel flow is adjusted.

7. In an engine control as set forth in claim 5 wherein the fuel flow is an idle fuel flow and the idle fuel flow is adjusted under conditions of low throttle opening.

8. In an engine control as set forth in claim 2 wherein the fuel supply system comprises a fuel injector.

9. In an engine control as set forth in claim 8 wherein the amount of fuel injected by the injector is varied in response to variations in trim condition.

10. In an engine control as set forth in claim 9 wherein the variations in fuel flow with respect to trim condition are only accomplished under conditions of low throttle opening.

11. In an engine control as set forth in claim 1 further including means for sensing the starting of the engine.

12. In an engine control as set forth in claim 11 further including means for adjusting the fuel system when the means for detecting engine starting indicates the initiation of an engine starting sequence.

13. An engine control for an outboard motor including an engine and adapted to be mounted for trim adjustment of the position of the outboard motor, said engine having means for starting the engine and a fuel system, the improvement comprising means for sensing the trim condition of the outboard motor, and means for adjusting the fuel system of the engine in response to the sensed trim condition and to starting.

14. In an engine control as set forth in claim 13 wherein the engine is provided with a fuel supply system in which the air fuel ratio may vary in response to trim angle.

15. In an engine control as set forth in claim 14 wherein the fuel supply system comprises a float operated device.

16. In an engine control as set forth in claim 15 wherein the float operated device comprises a carburetor.

17. In an engine control as set forth in claim 14 wherein the fuel supply system comprises a fuel injector.

* * * * *